United States Patent [19]

Swanson et al.

[11] 3,959,616

[45] May 25, 1976

[54] SPRING CONTACT ASSEMBLY FOR AN ELECTRICAL SWITCH

[75] Inventors: Howard E. Swanson, Chicago; William R. Rueth, Jr., Hazel Crest, both of Ill.

[73] Assignee: G & W Electric Specialty Company, Blue Island, Ill.

[22] Filed: Aug. 23, 1974

[21] Appl. No.: 499,832

[52] U.S. Cl. ..... 200/254; 339/262 R; 200/162; 200/164 R

[51] Int. Cl.[2] ..... H01H 1/42

[58] Field of Search ..... 200/162, 164 R, 164 A, 200/254, 279, 283, 246; 339/256 R, 258 R, 258 P, 258 F, 262 R, 262 F, 262 P

[56] References Cited

UNITED STATES PATENTS

| | | | |
|---|---|---|---|
| 2,539,230 | 1/1951 | Craig | 339/262 P X |
| 2,917,612 | 12/1959 | Chabot | 200/254 |
| 3,384,866 | 5/1968 | Nava | 339/256 R |
| 3,392,366 | 7/1968 | Nakazawa | 339/256 R X |
| 3,541,287 | 11/1970 | Wilson et al. | 200/283 X |
| 3,601,774 | 8/1971 | Stathos et al. | 339/258 R X |

*Primary Examiner*—Herman Hohauser
*Attorney, Agent, or Firm*—Fitch, Even, Tabin & Luedeka

[57] ABSTRACT

A spring contact assembly for an electrical switch is disclosed which permits the spring contacts and switch to withstand high close-into-fault current levels without adversely affecting the switch's continuous current rating during normal operation. The spring contact assembly includes a pair of spring contacts supported in opposed relation on a support fork, each spring contact having a symmetrical corrugated surface presenting a plurality of line contact surfaces to a contact bar when the spring contacts are brought into operative engagement with the contact bar, each spring contact further being supported in a manner to bias the corrugated contact surfaces against the contact bar. A protective shield may be provided for each spring contact to protect it from arc erosion.

13 Claims, 8 Drawing Figures

SPRING CONTACT ASSEMBLY FOR AN ELECTRICAL SWITCH

The present invention relates generally to electrical switches, and more particularly to an improved spring contact assembly for use in an electrical switch.

The spring contact assembly in accordance with the present invention is designed to permit the contacts and switch to close into fault in the order of 25,000 to 35,000 amperes symmetrical R.M.S. fault current without sustaining damage which would adversely affect the switch's continuous current rating during normal operation of the switch. In order to be commercially acceptable, such switches must withstand very high currents without any significant mechanical or thermal damage, and must thereafter operate in a satisfactory manner in transmitting their rated load currents.

A primary consideration in the design of contacts for closing into a fault current is the need to minimize contact bounce during a closing operation. Another design consideration is magnitude of the "magnetic blow-off" forces. These are the forces which tend to separate the contacting surfaces of the spring contacts due to constriction of the current at the contact points. Another design criterion is the desirability of providing a contact arrangement wherein the spring contacts allow a center contact bar to be engaged or disengaged from either side of the spring contacts to provide a pass-through feature as is desirable for multi-position switches. A still further design criterion is the desirability of protecting the spring contacts from arc erosion to prolong the useful life of the switch without substantial downtime for maintenance and repair.

It is a primary object of the present invention to provide an improved spring contact assembly for an electrical switch, which spring contact assembly meets the above enumerated design criteria for a switch having contacts which must be capable of withstanding high close-into-fault current levels without sustaining serious damage to the spring contacts.

Another object of the present invention is to provide an improved spring contact assembly for an electrical switch wherein the spring contacts have relatively light mass and high spring forces to minimize contact bounce during a close-into-fault operation.

Another object of the present invention is to provide a spring contact assembly for an electrical switch, which spring contact assembly employs pairs of spring contacts supported in opposed relation on the bifurcated end of a support fork, the spring contacts being adapted to receive a solid center contact bar therebetween in a manner such that deflection of one of the spring contacts is opposed by the opposite spring contact.

Another object of the present invention is to provide a spring contact assembly for an electrical switch wherein the spring contact assembly substantially reduces the magnetic forces which tend to separate the contacting surfaces during constriction of the current at the contact points by providing a multiplicity of independent contact points, the multiplicity of independent contact points also serving to minimize contact resistance to current flow such that heat generated at the contacts is minimized.

Still another object of the present invention is to provide a spring contact assembly as described wherein the opposed spring contacts are symmetrical about a plane containing the longitudinal axis of the support fork, the symmetrical spring contacts facilitating entry of a center contact bar between the opposed spring contacts from either side of the spring contact assembly to provide a pass-through feature.

Still another object of the present invention is to provide a spring contact assembly as described which may include an arc shield associated with each of the spring contacts to protect the spring contacts from arc erosion.

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

Figure 1:
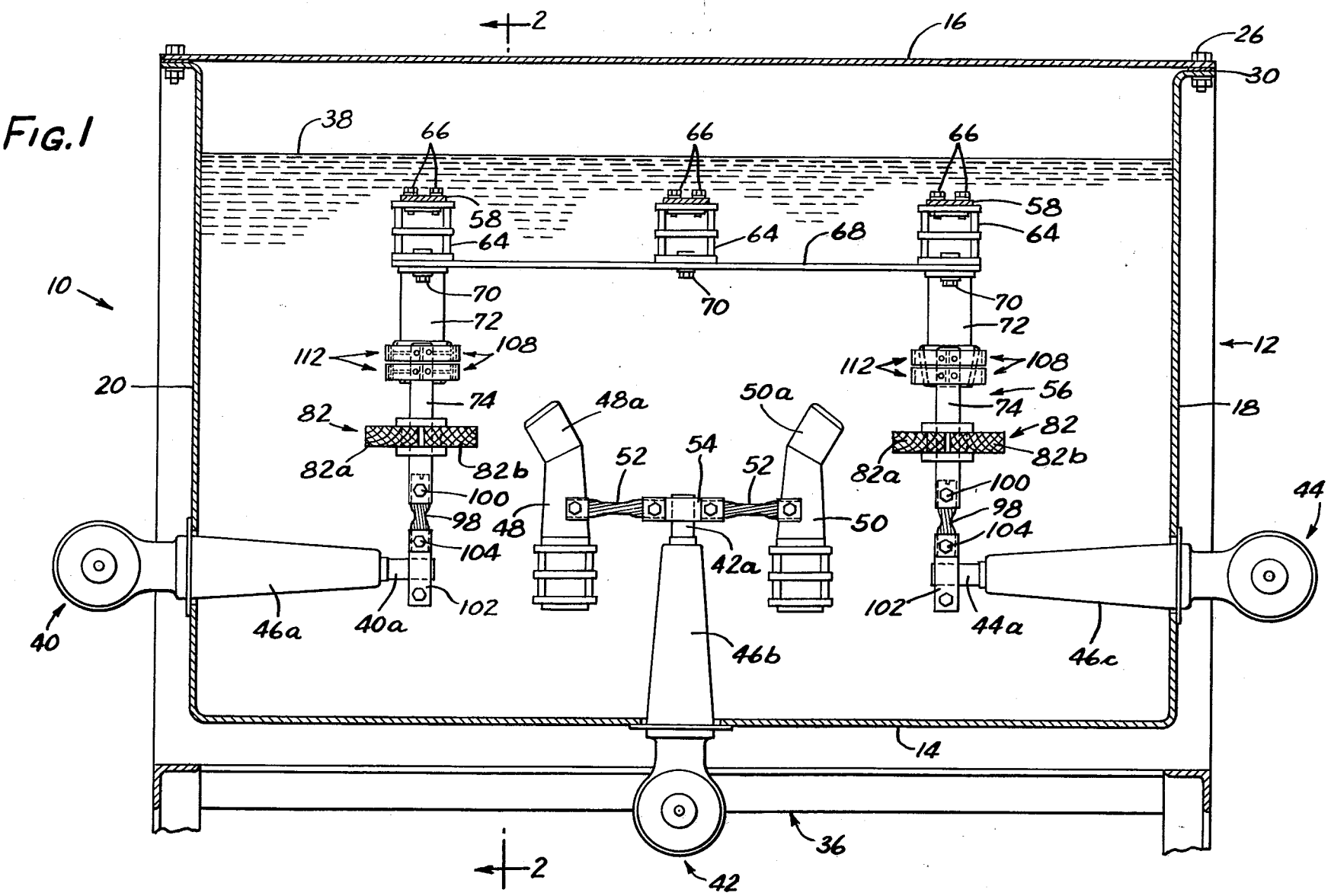
FIG. 1 is a vertical sectional view, taken substantially along the line 1—1 of FIG. 2, of an electrical switch employing spring contact assemblies constructed in accordance with the present invention.
Figure 2:
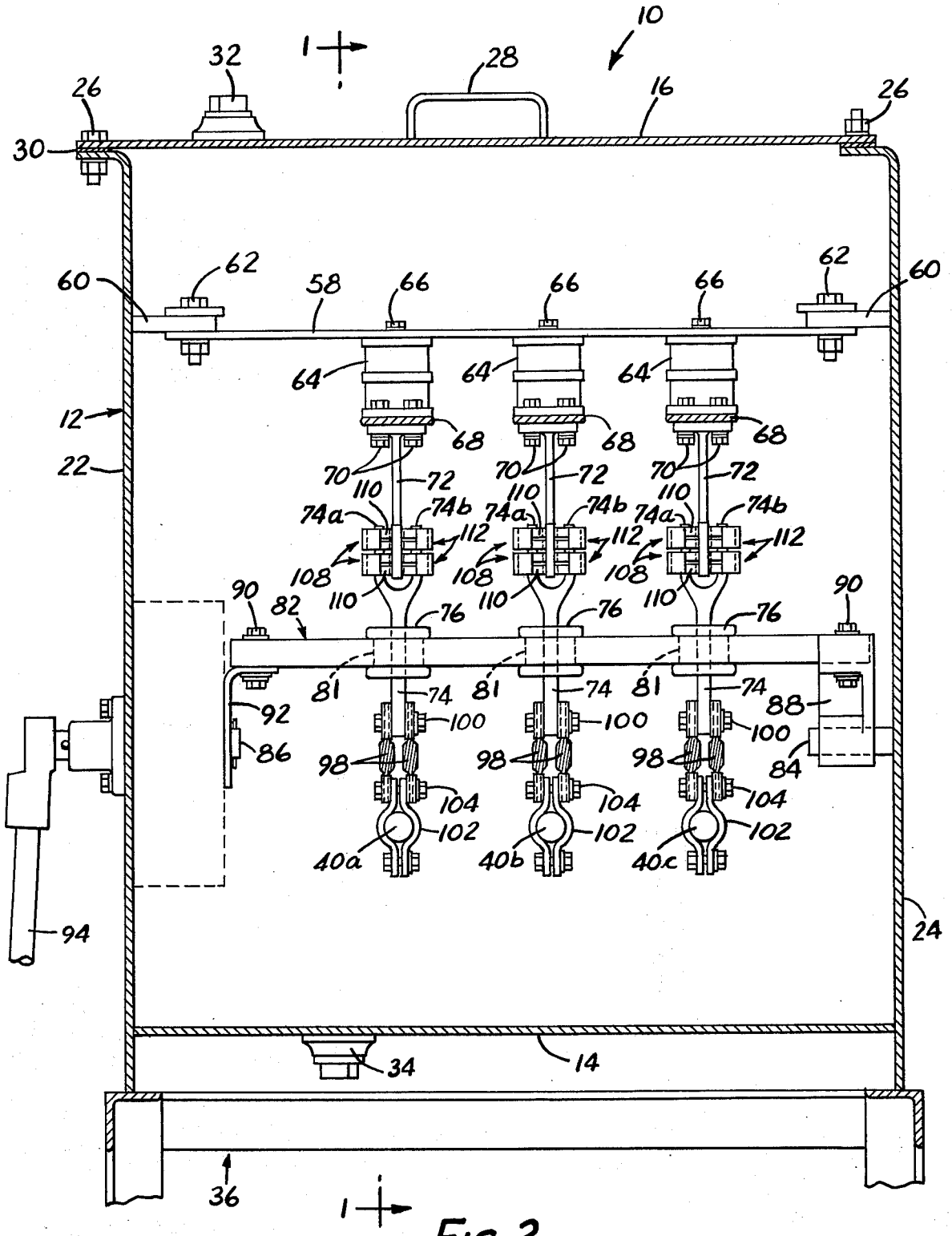
FIG. 2 is a vertical sectional view taken substantially along the line 2—2 of FIG. 1 and illustrates the pivotal mounting of three spring contact assemblies in accordance with the present invention for three-phase operation.

Referring now to the drawings, and in particular to FIGS. 1 and 2, the present invention is described, by way of illustration, as being employed in an electrical switch structure indicated generally at 10. The electrical switch structure 10 may comprise a three phase electrical switch adapted for polyphase circuit operation. The switching elements, to be described hereinafter, are located within a container tank, indicated generally at 12, having a bottom wall 14, a top wall 16, vertical end walls 18 and 20 (FIG. 1), and front and rear vertical walls 22 and 24 (FIG. 2). The bottom wall 14 may be formed integral with the end walls 18 and 20, while the front and rear walls 22 and 24, respectively, are suitably secured to the edges of the bottom and end walls.

The top wall 16 is preferably releasably secured to upper flange portions of the end walls and front and rear walls by bolts 26, or other suitable means, to allow the top wall to be removed from the remaining portion of the tank for maintenance purposes and the like. To this end, the top wall 16 may have a handle 28 secured to its upper surface. A gasket seal 30 is interposed between the upper wall 16 and the adjacent upper flanges of the four vertical walls of the tank 12. The top wall 16 is provided with a filling plug 32 and the bottom wall 14 has a similar drain plug 34. The container tank 12 may be supported on a support platform, a portion of which is indicated at 36, and conventionally is filled with liquid dielectric insulating media such as transformer oil, askerel, silicone fluid or dielectric grade insulating gases, such as sulfur-hexafluoride ($SF_6$). The liquid dielectric insulating media is preferably filled to a level as indicated at 38 in FIG. 1.

The tank 12 supports a plurality of service entrances, two of which are indicated generally at 40 and 42 in FIG. 1, and a load conductor indicated generally at 44. For purposes of description, the service entrance 40 will be described as a supply conductor and the service entrance 42 will be described as a "future use" or emergency supply conductor. The supply conductor 40, the emergency supply conductor 42 and the load conductor 44 are of conventional design and are insulated from the respective walls of the tank 12 by identical bushings 46*a*, 46*b*, and 46*c*, respectively. Each of the conductors 40, 42 and 44 has an inner end portion 40*a*, 42*a* and 44*a*, respectively, which extends inwardly of the tank 12 for connection to a braid conductor bracket as will be described more fully below.

The supply conductor 40, the emergency supply conductor 42 and the load conductor 44 shown in FIG. 1 may each represent one phase of a typical three phase electrical switch, the remaining two conductors for each phase being disposed in rearward alignment along the tank 12, such as shown in FIG. 2 by the conductors 40*a*, 40*b* and 40*c* representative of the three phases of the supply conductors 40.

The inner end 42*a* of each of the three emergency use conductors 42, only one of which is shown in FIG. 1, is conductively connected to an associated pair of stationary bar contacts 48 and 50 through conventional braid conductors 52. The braid conductors 52 have their ends adjacent the conductor 42*a* connected to the conductor 42*a* through a connector bracket 54 in a known manner. The bar contacts 48 and 50 have upper terminal ends 48*a* and 50*a*, respectively.

Each of the supply entrance conductors 40 and each of the load entrance conductors 44 has a movable contact assembly, indicated generally at 56, operatively associated therewith for selectively connecting the respective supply and load entrance conductors in closed circuit with each other or selectively connecting either of the supply or load conductors to the emergency use conductor 42. In the illustrated embodiment, the movable contact assemblies 56 are shown in positions to connect the supply entrance conductors 40 in circuit with the load entrance conductors 44. As will become more apparent hereinbelow, if a failure should occur in the electrical power supply to the supply entrance 40, the movable contact assemblies 56 associated with the load conductors 44 may be moved to positions wherein they connect the load conductors to the emergency use conductors 42 through the stationary bar contacts or terminals 50. It will be appreciated that the illustrated supply entrance conductors 40, emergency use entrance conductors 42 and load entrance conductors 44 may be interchanged or altered for their particular function in accordance with the desired operation of the switch structure 10, the described embodiment being but one of a number of various ways in which the respective service entrances may be connected.

In the embodiment illustrated in FIGS. 1 and 2, three supporting stringers 58 are supported by and between the forward and rear walls 22 and 24, respectively, of the tank 12. To this end, each stringer 58 has its opposite ends secured to inwardly projecting support arms 60 suitably attached to the inner surfaces of the associated vertical walls 22 and 24. Support bolts 62 may be employed to secure the supporting stringers 58 to the support arms 60. The stringers 58 are disposed in parallel spaced relation and each has three stand-off insulators 64 secured to the lower surface thereof by means of suitable support screws 66. The stand-off insulators 64 are of known design. The stand-off insulators 64 supported by each of the stringers 58 are supported in aligned relation transverse to the longitudinal axis of the tank 12, with each set of three stand-off insulators being also aligned with the next adjacent set of stand-off insulators such that the stand-off insulators are also aligned in the longitudinal direction of the tank 12.

Each set of three stand-off insulators 64, considered in the longitudinal direction of the tank 12, supports a bus bar 68 through suitable bolts 70. A stationary contact bar or conductor 72 is supported by each of the stand-off insulators 64 comprising the left-hand and right-hand transverse rows of stand-off insulators, as considered in FIG. 1, through the support bolts 70 such that the upper ends of the stationary contact bars 72 are in conductive relation with the associated bus bars 68. The stationary contact bars 72 associated with the left-hand row of stand-off insulators 64, as considered in FIG. 1, are positioned such that their longitudinal axes intersect and are generally perpendicular to the longitudinal axes of the associated supply entrance conductors 40. Similarly, the stationary contact bars 72 associated with the right-hand row of stand-off insulators 64 are positioned such that their longitudinal axes intersect and are generally perpendicular to the longitudinal axes of the corresponding load entrance conductors 44.

The portion of the switch structure 10 as thus far described, except for the contact assemblies 56, is of generally known design, and illustrates but one type of switch structure with which the movable contact assemblies 56 in accordance with the present invention may be employed.

Each of the movable contact assemblies 56 includes a support fork 74 which has a bifurcated end defined by a pair of parallel spaced support arms 74*a* and 74*b*. Each of the support forks 74 has an insulator 76 fixedly secured in predetermined relation along the longitudinal length of the fork. Each of the insulators 76 is preferably formed in situ on its associated fork 74 and may comprise an epoxy casing or procelain insulator which has an integral portion 78 formed within a transverse bore 80 in the associated fork 74 so as to fix the insulator along the longitudinal length of the fork. Each of the insulators 76 has an annular groove or recess 81 formed thereon which provides means for fixedly supporting the associated support fork 74 on a rocker arm 82. The rocker arm 82 may be formed a pair of mating laminated wood portions 82*a* and 82*b* (FIG. 1) which are suitably secured together and have complementary recesses adapted to engage the groove portions 81 of the insulators 76 to support the associated support forks 74.

In the illustrated embodiment, a pair of the rocker arms 82 are provided, with each having its opposite ends supported in a manner to allow rotation of the rocker arm about an axis defined by a stub shaft 84, secured in normal relation to the rear tank wall 24, and a rotatable actuating shaft 86, supported by and in normal relation to the front tank wall 22. The stub shaft 84 rotatably supports a support arm 88 secured to an end of the associated rocker arm 82, as through a mounting bolt 90. The opposite end of the rocker arm 82 is connected to an actuating arm 92 through a similar mounting bolt 90, the actuating arm 92 being fixedly retained on the actuating shaft 86 such that rotation of the actuating shaft 86 effects a corresponding rotational movement of the associated rocker arm 82 and the support forks 74 carried thereon. Each of the actuating shafts 86 (only one of which is shown) extends outwardly of the tank wall 22 and may have a handle mechanism 94 secured to its outer end for selectively manually rotating the actuating shaft 86 and the associated rocker arm 82. Alternatively, the handle mechanisms 94 may each be connected to an automatic transfer device of known design for effecting selective transfer of the contact assemblies 56 upon a predetermined condition.

The support forks 74 are conventionally made of a conductive material such as cast or fabricated aluminum or copper and have end portions 74*c* connected to the inner ends 40*a* and 44*a*, respectively, of the associated supply and load conductors 40 and 44. The ends 74*c* of the forks 74 are connected to the corresponding inner ends 40*a* and 44*a* of the supply and load conductors through pairs of braid connectors 98 which have their opposite ends connected, respectively, to the ends 74*c* of the forks 74, as by connecting bolts 100, and to conductive connecting brackets 102, as by similar connecting bolts 104. The connecting brackets 102 are identical to the connecting brackets 54 and are secured on inner ends 40*a* and 44*a* of the associated supply and load conductors 40 or 44.

The present invention is particularly directed to providing spring contact assemblies for the movable contact assemblies 56 which will permit the spring contacts and switch to close into 25,000 to 35,000 ampere symmetrical R.M.S. fault current without sustaining damage detrimental to the operation of the switch's continuous current rating during normal operation. To this end, each of the support forks 74 has at least one spring contact assembly, indicated generally at 108, supported on each of its upper spaced support arms 74*a* and 74*b*. Preferably, four spring contact assemblies 108 are provided on each of the support forks 74, two spring contact assemblies 108 being supported on each of the support arms 74*a* and 74*b*.

Figure 3:
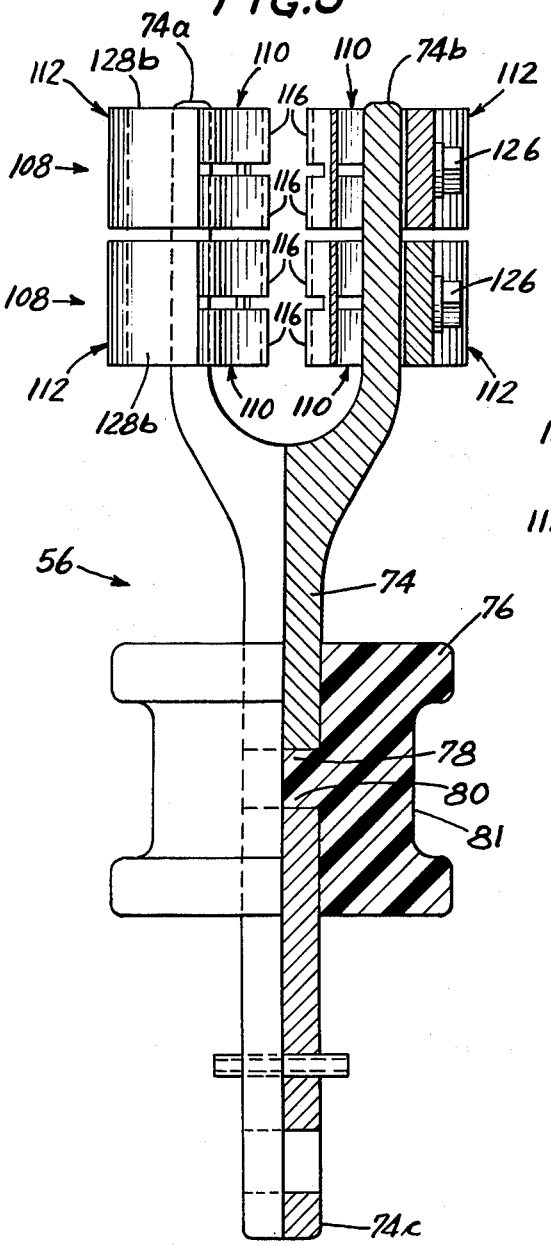
FIG. 3 is an elevational view, partly in longitudinal section, of a spring contact assembly constructed in accordance with the present invention.
Figure 4:
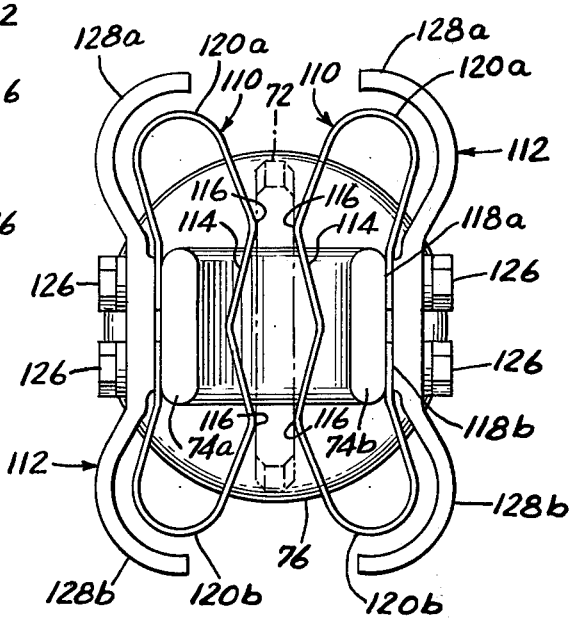
FIG. 4 is an enlarged top plan view of the spring contact assembly of FIG. 3.
Figure 7:
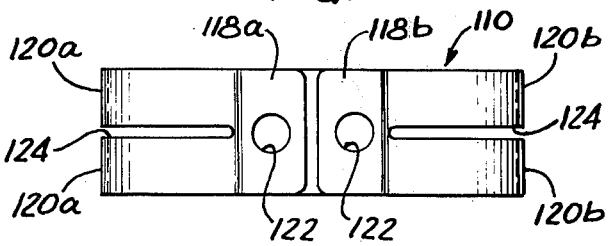
FIG. 7 is a rear elevational view of the spring contact of FIG. 5.
Figure 6:
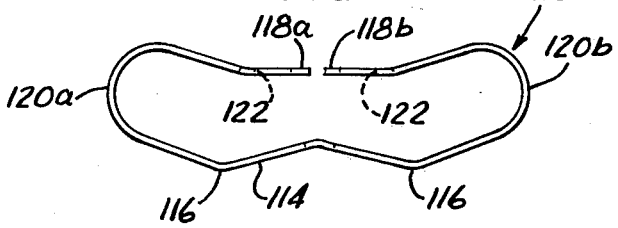
FIG. 6 is a plan view of the spring contact of FIG. 5.
Figure 8:
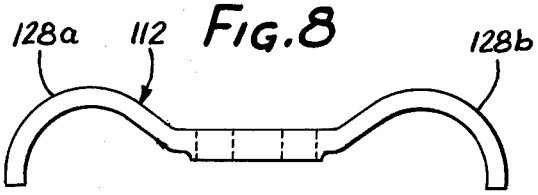
FIG. 8 is a top plan view of an arc shield as may be employed in the spring contact assembly of FIG. 3.
Figure 5:
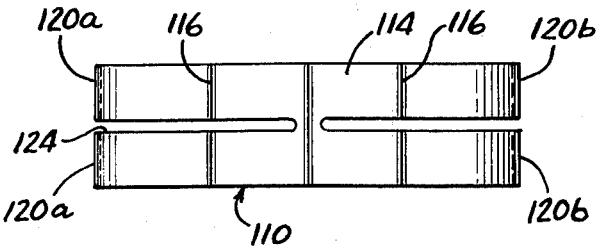
FIG. 5 is a front elevational view of a spring contact as employed in the assembly of FIGS. 3 and 4.

With particular reference to FIG. 3, taken in conjunction with FIGS. 4–8, each of the spring contact assemblies 108 includes a spring member 110, and may also include an arc shield 112. Each of the spring contact members 110 is formed from a strip of conductive material, such as CDA No. 175 beryllium copper having a Rockwell B hardness of 95 minimum and a conductivity of 48% I.A.C.S. minimum. Each spring contact member 110 includes a corrugated intermediate surface portion 114 which defines a pair of parallel spaced outwardly projecting ridges 116 adapted for substantially line contact with a fixed contact bar, such as 48*a*, 50*a* or 72, when brought into engagement therewith, as will become more apparent below. Each of the spring contact members 110 has opposite end portions 118*a* and 118*b* which are formed to extend rearwardly of and generally parallel to a plane containing the contact ridges 116 of the corrugated contact surface 114. In forming the opposite ends 118*a* and 118*b* of a spring contact member 110 as described, curved end portions 120*a* and 120 *b* are established which provide a resilient connection of the forward corrugated surface 114 to the rearwardly lying opposite ends 118*a* and 118*b* of the spring contact member.

Each of the opposite ends 118*a* and 118*b* of the spring contact members 110 has a suitable opening 122 (FIG. 7) provided therethrough for mounting the spring contact members 110 on the spaced support arms 74*a* and 74*b* of the support forks 74. Noting FIG. 4, each of the spring contact members 110 is secured onto its associated support arm 74*a* or 74*b* by screws 126 such that the end portions 118*a* and 118*b* are connected to the outer surface of the corresponding support arm, while the corrugated surface 114 projects in the direction of the opposed contact spring member 110. In this manner, the corrugated surfaces 114 of opposing spring contact members 110 are in opposed, spaced, parallel relation with their ridge projections 116 being parallel. When mounted on a support fork 74, the spring contact members 110 are symmetrical about a plane containing the longitudinal axes of the fork support arms 74*a* and 74*b*, considered in plan view as in FIG. 4.

Each of the spring contact members 110 has a slot 124 formed along its longitudinal axis which extends less than the full length of the strip material from which the spring contact is made. The slot 124 divides the forward corrugated surface 114 and the curved end portions 120*a* and 120*b* into two parallel sections integrally connected at the opposite end portions 118*a* and 118*b* of the spring contact member.

Preferably, two pairs of opposed spring contact members 110 are supported on each of the support forks 74, as illustrated in FIG. 3. In this manner, eight lines of contact, as defined by the forwardly projecting ridges 116, are provided on each side of the plane containing the longitudinal axes of the support arms 74*a* and 74*b*. In total, sixteen lines of contact 116 are provided on each of the support forks 74 for conductive contact with a contact bar when a contact assembly 56 is moved to a position to receive a contact bar between the spring contact members 110 in full engagement with the projecting ridges 116.

As noted, each of the spring contact assemblies 108 may include an arc shield 112. Each arc shield 112 is mounted outwardly of an associated spring contact member 110 and is secured by the screws 126 to the same support arm 74*a* or 74*b* on which the associated spring contact 110 is mounted. Each of the arc shields 112 has a width, considered as a vertical dimension in FIG. 3, substantially equal to the width of the corresponding spring contact member 110. Each arc shield 112 is symmetrical about its center, when considered in plan as in FIG. 4, and has curved end portions 128*a* and 128*b* which have curvatures similar to the curved end portions 120*a* and 120*b* of the associated spring contact 110. The curved end portions 128*a* and 128*b* of each arc shield 112 are spaced rearwardly from the curved ends of the associated spring contact 110. The arc shields 112 may be cast, forged or stamped, and protect the associated spring contact members 110 from arc erosion as might occur during current interruption when an arc might be drawn between a spring contact member and a stationary contact bar or terminal, such as 48*a*, 50*a* or 72. The curved end portions 128*a* and 128*b* of the arc shields 112 extend approximately 180*L*about the curved end portions 120*a* and 120*b*, respectively, of the associated spring contact members 110.

With the spring contact assemblies 108 mounted on the spaced support arms 74*a* and 74*b* of the support forks 74 as described, it can be seen that movement of the flat rocker arms 82 to generally horizontal positions, as shown in FIG. 1, will effect connection of the supply entrance conductors 40 to the fixed contact bars or terminals 72 associated with the left-hand ends of the bus bars 68. Similarly, the right-hand fixed conductor bars 72 will be connected through the right-hand spring contact assemblies 108 to the load entrance conductors 44. The electrical power supply to the service entrance 40 will thus be connected by the bus bars 68 to the right-hand set of fixed conductor bars or terminals 72 and through the associated movable contact assemblies 56 to the load entrance conductor 44. Should a discontinuity or failure occur in the power supply to the supply entrance conductors 40, the right-hand contact assemblies 56 may be manually or automatically moved by the operating rods 94 to positions connecting their spring contact assemblies 108 to the upper ends 50*a* of the fixed contact bars or terminals 50 so as to connect the load conductors 44 to the emergency use service entrance conductors 42.

In similar fashion, if the service entrance conductors 44 are employed as the power input to the switch 10, and the service entrance conductor 40 is used as the load conductor, failure in the electrical power supply to the conductors 44 could be offset by moving the left-hand contact assemblies 56 to positions wherein their spring contact assemblies 108 receive the upper ends 48*a* of the stationary contacts 48 therebetween to connect the then load conductors 40 to the emergency use conductors 42.

By providing sets of spring contact members 110 as described, when the spring contacts are moved to close into a 25,000 to 35,000 ampere symmetrical R.M.S. fault current, the light mass and high spring force of the spring contacts 110 will minimize contact bounce. Additionally, the opposed pairs of spring contact members 110 serve to resiliently oppose each other such that deflection of the opposed pairs of spring contacts is substantially eliminated.

As noted above, when switch contacts are moved to close into a very high ampere fault current, magnetic blow-off forces are created which tend to separate the contacting surfaces due to the constriction of the current at the contact points. In accordance with the present invention, the spring contact members 110 reduce these blow-off forces by providing a multiplicity of independent contact points as defined by the projecting ridges 116. Initially, eight such contact points 116 engage a fixed contact bar as it is introduced between the pairs of opposed spring contact assemblies 108, while sixteen contact points are engaged by the contact bar when it is fully received within the spring contact assemblies 108 in engagement with all of the contacting ridges 116.

By providing symmetrical spring contact members 110, and by fixedly securing their opposite ends 118*a* and 118*b* to the associated spaced support arms 74*a* and 74*b* of the support forks 74, contact bar terminals may be brought into engagement with the opposed pairs of spring contacts 110 from either side of center thereof, as by moving the spring contacts relative to stationary contact bars or by moving center contact bars relative to generally stationary spring contact assemblies 108. In this manner, a pass-through feature is provided which particularly adapts the spring contact assemblies 108 for multi-position switches.

When using the spring contact assemblies 108 for current interruption, arcs may be drawn between the beryllium copper spring members 110 and the contact bars, such as 48*a*, 50*a* and 74. The arc shields 112 serve to provide preferred directions for such electrical arcing and thereby protect the spring contact from arc erosion.

While preferred embodiments of the present invention have been illustrated and described, it will be obvious to those skilled in the art that changes and modifications may be made therein without departing from the invention in its broader aspects. Various features of the invention are defined in the following claims.

What is claimed is:

1. A contact arrangement for use in an electrical switch and the like, comprising, in combination, a support member having a pair of spaced support arms, an electrically conductive spring contact member supported on each of said support arms to define a pair of opposed spring contact members, each spring contact member having a generally corrugated contact surface defining at least two projecting ridges, each spring contact member further having opposite ends looped to extend toward each other rearwardly of said corrugated contact surface, said opposite ends of each spring contact member being secured to their associated support arm such that said corrugated contact surfaces are in opposed relation to each other with said ridges being adapted to engage a contact bar along lines of contact when said contact bar is brought into engagement with said ridges.

2. A contact arrangement as defined in claim 1 wherein said support arms of said support member are disposed in substantially parallel relation, and wherein said spring contact members are mounted on said support arms in opposed relation such that said ridges are generally parallel and engage said contact bar along parallel lines of contact when said contact bar is brought into engagement with said ridges.

3. A contact arrangement as defined in claim 1 wherein said spring contact members are symmetrical about a plane containing the longitudinal axes of said spaced support arms.

4. A contact arrangement as defined in claim 1 wherein said spring contact members are formed from sheet metal and are adapted to resiliently bias said ridges into engagement with said contact bar.

5. A contact arrangement as defined in claim 1 wherein each of said spring contact members has a slot therethrough to establish at least four independent projecting ridge surfaces on each of said spring contact members.

6. The combination of claim 1 further including a second pair of said spring contact members supported on said spaced support arms in opposed relation such that at least eight opposed ridges are provided for line contact with a contact bar brought into engagement with said ridges.

7. The combination of claim 1 wherein each of said spring contact members is formed from a generally rectangularly shaped conductive blank having a slot extending along its longitudinal axis intermediate opposite ends of said blank, each spring contact member thereby defining a pair of generally parallel corrugated contact surfaces each of which has a pair of projecting ridges disposed transverse to said slot, the opposite ends of said spring contact members being secured to their associated support arm such that said ridges of said opposed corrugated surfaces are in parallel spaced relation.

8. The combination of claim 7 further including a second electrically conductive spring contact member supported on each of said support arms to establish two pairs of opposed identical spring contact members each of which has four parallel contact ridges thereon, said opposed pairs of spring contact members establishing 16 contact ridges for contacting relation with a contact bar when positioned between said pairs of spring contact members in engagement with said ridges.

9. The combination of claim 8 wherein each of said spring contact members is symmetrical about a plane containing the longitudinal axes of said spaced support arms.

10. A contact arrangement as defined in claim 1 including an arc shield supported on each of said support arms rearwardly of and adjacent to each of said spring contact members to provide a preferred location for electrical arcing that may occur.

11. The contact arrangement of claim 10 wherein each of said arc shields includes curved end portions each of which is adapted to partially encircle a looped portion of the corresponding spring contact member.

12. A spring contact member for use in an electrical switch and the like to establish electrical contact between a conductor bar and a supply conductor adapted for connection to a source of electric current, said spring contact member being made from a strip of conductive material and having a corrugated intermediate contact surface defining at least two projecting ridges, said spring contact member further having opposite ends looped to extend toward each other rearwardly of said corrugated contact surface, said opposite ends being adapted for connection to said supply conductor with said corrugated contact surface disposed to effect biased engagement of said ridges with said contact bar lines of contact.

13. In a switch contact structure which includes a pair of spaced conductive terminals having selective connection with a source of electric current, the axes of said terminals lying in a common plane, the combination therewith of at least one conductive contact element carried by each terminal, each contact element having a generally corrugated surface directed to one side of its associated terminal in opposed relation to the generally corrugated surface of the other contact element, each contact element further having a pair of opposite end portions curved to extend in a direction toward each other and being disposed rearwardly of the associated corrugated surface, said end portions being connected to their associated terminal and cooperating with said curved portions to yieldingly maintain the associated corrugated surface in spaced relation from the associated terminal, each of said contact elements being symmetrical relative to said common plane containing the longitudinal axes of said terminals.

* * * * *

UNITED STATES PATENT AND TRADEMARK OFFICE

CERTIFICATE OF CORRECTION

PATENT NO. : 3,959.616

DATED : May 25, 1976

INVENTOR(S) : William R. Rueth, Jr. & Howard E. Swanson

It is certified that error appears in the above-identified patent and that said Letters Patent are hereby corrected as shown below:

Column 2, line 68, "askerel" should read --askarel--

Column 4, line 47, "casing" should read --casting--

Column 4, line 54, after "formed" insert --from--

Column 5, line 49, after "includes a spring" insert --contact--

Column 6, line 66, "180L" should read --180°--
Spec. page 14, line 21

Column 10, line 11, Claim 12, after "contact bar" insert --along--

Signed and Sealed this

Ninth Day of November 1976

[SEAL]

*Attest:*

RUTH C. MASON
*Attesting Officer*

C. MARSHALL DANN
*Commissioner of Patents and Trademarks*